US006546108B1

(12) United States Patent
Shennib et al.

(10) Patent No.: US 6,546,108 B1
(45) Date of Patent: Apr. 8, 2003

(54) HEARING DEVICE WITH PROTRUDING BATTERY ASSEMBLY

(75) Inventors: Adnan Shennib, Fremont, CA (US); Richard C. Urso, Redwood City, CA (US)

(73) Assignee: iHear Systems, Danville, CA (US)

( * ) Notice: Subject to any disclaimer, the term of this patent is extended or adjusted under 35 U.S.C. 154(b) by 0 days.

(21) Appl. No.: 09/386,788

(22) Filed: Aug. 31, 1999

(51) Int. Cl.[7] ..... H04R 25/00

(52) U.S. Cl. ..... 381/322; 381/323; 429/98; 429/100

(58) Field of Search ..... 381/314, 322, 381/323, 324, 328, FOR 133, FOR 135, FOR 137; 181/129, 130, 135; 429/86, 89, 96, 100, 27

(56) References Cited

U.S. PATENT DOCUMENTS 4,153,758 A * 5/1979 Cerny ..... 381/323
5,687,242 A * 11/1997 Iburg ..... 381/328
5,701,348 A * 12/1997 Shennib et al. ..... 381/322
5,724,431 A * 3/1998 Reiter et al. ..... 381/322
5,799,095 A * 8/1998 Hanright ..... 381/328
6,208,741 B1 * 5/2001 Shennib et al. ..... 381/322

FOREIGN PATENT DOCUMENTS

JP 356089200 A * 7/1981 ..... 381/FOR 133

* cited by examiner

*Primary Examiner*—Curtis Kuntz
*Assistant Examiner*—Suhan Ni

(57) ABSTRACT

A hearing device system includes a hearing device having a normally open (i.e., doorless) receptacle cavity configured to accept a battery assembly for powering the hearing device. The battery assembly has an insertable segment and protruding segment, the protruding segment remains outside of the receptacle cavity of the hearing device when the insertable segment of the battery assembly is operably seated (i.e., firmly engaged, with electrical connection established to the hearing device) within the receptacle cavity. A battery dispenser holds one or more new battery assemblies for direct transfer of one of the held battery assemblies into the receptacle cavity of the hearing device to replace a depleted battery assembly when the latter is removed from the receptacle cavity.

21 Claims, 8 Drawing Sheets

HEARING DEVICE WITH PROTRUDING BATTERY ASSEMBLY

BACKGROUND OF THE INVENTION a. Technical Field

The present invention relates to hearing devices, and, more particularly, to miniature hearing devices for inconspicuous wear.

b. Description of the Prior Art (1) The Challenges of Miniature Canal Devices

The benefits of miniature hearing device for placing deep in the ear canal are many. They include improved high frequency response, less distortion, reduction of feedback and improved telephone use (Chasin, M. *CIC [Completely In the Canal] Handbook*, Singular Publishing, pp 10–11, 1997, referred to hereinafter as "Chasin"). A major benefit for "an invisible hearing device" for the user is cosmetic in nature since hearing aid use is often associated with aging and disability. Hearing devices that fit deep in the ear canal are typically one of two types: (1) In-The-canal (ITC) type which fits largely in the concha cavity (3 in FIG. 4 hereof) and extends into the ear canal 1, or; (2) Completely-In-the-Canal (CIC) type which fits completely within the ear canal 1 past the aperture 2 as shown in FIG. 5 hereof.

A conventional hearing device includes a battery, a microphone, an amplifier, and a receiver (speaker), among other components, all of which are housed within an outer shell composed of acrylic or plastic material. A movable battery enclosure, in the form of a door, lid or a compartment, is typically provided to enclose the battery of the device within and to facilitate its removal when depleted. Removal is typically performed by opening the enclosure and manually grasping the battery with fingers (for example see 24 in FIGS. 1 and 2 in U.S. Pat. No. 4,272,591 to Brander). Since battery enclosures are generally permanent structures within a conventional hearing device, they must be made durably thick to last for the life expectancy of the hearing device. For example, the wall thickness of battery doors is typically greater than 0.5 millimeter (mm). Various physical features of battery enclosures (i.e., hinge, hinge-receptacle, locking features, door-knobs, etc.) occupy valuable space within a hearing device. These and other space inefficiencies associated with battery enclosures of conventional hearing devices add significant challenges in the fabrication and fit of miniature hearing devices.

With continued improvements in miniaturization of hearing aid components, the battery has emerged as the largest single component in canal hearing devices (ITC and CIC devices are collectively referred to herein as canal devices). Resorting to smaller batteries to reduce the overall size of the device is not practical for most users who expect a prolonged use of their batteries prior to depletion and replacement. Eliminating space-inefficiencies of battery enclosures will have a significant impact on reducing the overall size and improving the fit of miniature hearing devices.

Another problem associated with battery enclosures of conventional devices is related to the placement and removal of the battery. The tiny size of a door and hearing aid battery present a serious dexterity challenge to many hearing aid users who are elderly and may suffer from hand-tremors, arthritis, poor vision and other ailments that limit their ability to manipulate small structures.

(2) State of the art in Battery Enclosure in Hearing Devices

As mentioned above, prior art hearing devices typically comprise a movable battery enclosure contained within a shell at the lateral (face-plate) side of the hearing device. For example, U.S. Pat. No. 5,201,008 to Arndt et al. ("Arndt") describes an open-topped battery compartment (24 in FIG. 1 of Arndt) and subsequently covered by a lid (16 in FIG. 1 of Arndt). The space inefficiencies associated with the movable battery compartment and lid prohibit the fabrication of highly miniature canal device for deep fitting in the ear canal.

U.S. Pat. No. 4,153,758 to Cerny ("Cerny") describes a miniature holder and carrier of a battery for positioning it into the door of a hearing device. Although Cerny's proposal may facilitate insertion and removal of the battery into and from the hearing device, no space efficiencies are realized by the proposal since a battery door is still required for proper operation as disclosed.

U.S. Pat. No. 4,931,369 to Hardt et al. ("Hardt") describes a battery enclosure or chamber formed by the housing and movable cover. Thus, a separate battery compartment is eliminated for improved space efficiency. However, since the formed chamber completely surrounds the battery placed within, the thickness of the enclosure also occupies valuable space. Furthermore, Hardt's arrangement requires considerable manual dexterity from the user to manipulate the miniature cover and to position or remove the battery within it.

U.S. Pat. No. 5,784,470 to Fackler et al. ("Fackler") describes a space efficient hinged battery door and faceplate arrangement for a CIC device. The battery enclosure partially protrudes from the face-plate (FIG. 3 of Fackler) thus allowing the battery to occupy less space within the shell and effectively reducing the volume of the shell for deeper positioning within the ear canal. However, the miniature door also presents a challenge for those with limited dexterity as mentioned above.

U.S. Pat. No. 5,117,997 to Voroba ("Voroba") describes a battery dispenser apparatus, which aids in the dispensing and removal of hearing aid batteries. The apparatus is clearly designed for conventional hearing aids (30 in FIG. 1 of Voroba) which comprise a hinged battery door/compartment (32) for opening and placing the battery within. Similarly, a miniature door/compartment for canal devices presents a serious challenge for those with limited manual dexterity.

It is a principal objective of the present invention to provide a highly space efficient canal hearing device for positioning deep in the ear canal.

Another objective of the invention is to provide a battery assembly which is highly accessible, and thus easily inserted and removed without requiring a door or a movable battery compartment.

Yet another objective is to provide a battery dispenser which is adapted to enable easy and direct transfer of a battery therefrom into operative engagement with the hearing device, thus eliminating a need for handling and manipulation of the battery itself by the user.

SUMMARY OF THE INVENTION

The present invention provides a space efficient battery assembly and convenient replacement method for miniature hearing devices. The battery assembly is partially inserted into a receptacle cavity within a hearing device. The battery assembly has a protruding segment, which remains outside the battery cavity and is directly exposed to the environment of the ear outside the hearing device. The battery assembly comprises a thin-walled covering affixed or molded to its protruding segment, thus disposable along with the battery. The insertable segment of the battery assembly provides electrical and mechanical connectivity with the receptacle cavity of the hearing device. The partial insertion of the battery assembly conserves valuable space within the housing of the hearing device of the present invention, thus allowing for deeper insertion into the ear canal. Further reduction in the size of the hearing device is achieved by eliminating a movable door or battery compartment typically employed in conventional hearing aid designs. Such a battery assembly is highly accessible and thus easy to place and remove. This is particularly useful for the elderly who may have limited manual dexterity or poor eyesight.

In a preferred embodiment of the invention, a battery dispenser holding several battery assemblies is provided. The battery dispenser facilitates the placement of a battery assembly by directly transferring a battery assembly from the dispenser to the hearing device, without resorting to any direct manual manipulation of the battery assembly. This is accomplished by first holding the hearing device and introducing its receptacle cavity onto the insertable segment of a battery assembly exposed within the dispenser. Once the insertable segment of the battery assembly is fully inserted into the receptacle cavity of the hearing device, the retention force within the receptacle cavity causes the battery assembly to disengage from the dispenser as the hearing device is being removed away from the dispenser area. In the preferred embodiment, the battery dispenser is in the form of a disposable cartridge, which also comprises an extractor and a disposal reservoir for the removal and storage of depleted battery assemblies.

BRIEF DESCRIPTION OF THE DRAWINGS

The above and still further objectives, features, aspects and attendant advantages of the present invention will become apparent from the following detailed description of certain preferred and alternate embodiments and method of manufacture thereof constituting the best mode presently contemplated of practicing the invention, when taken in conjunction with the accompanying drawings, in which:

FIGS. 10A–C are side views illustrating the sequence of the direct transfer process of the battery assembly from a battery dispenser onto the hearing device, in which FIG. 10A shows a receptacle cavity of a hearing device being introduced onto a battery assembly which is weakly held within a cavity of the battery dispenser; FIG. 10B shows the battery assembly fully inserted within the receptacle cavity which has greater holding force than that of the dispenser cavity; and FIG. 10C shows the battery assembly firmly attached to (i.e., captured by) the receptacle cavity so as to disengage the battery assembly from the dispenser when the hearing device is removed away from the dispenser area;

FIGS. 11A–D are perspective views of the extractor unit illustrating the sequence of removing and storing depleted battery assemblies, in which FIG. 11A shows a battery assembly attached to a hearing device being moved toward insertion into an extractor guide cavity; FIG. 11B shows the protruding segment of the battery assembly inserted within the extractor guide cavity for sliding into a removal slot thereof; FIG. 11C shows the protruding segment engaged and held within the removal slot; and FIG. 11D shows the battery assembly extracted from the hearing device into a reservoir for subsequent disposal thereof;

DETAILED DESCRIPTION OF PRESENTLY PREFERRED EMBODIMENTS AND METHODS OF THE INVENTION

Figure 1:
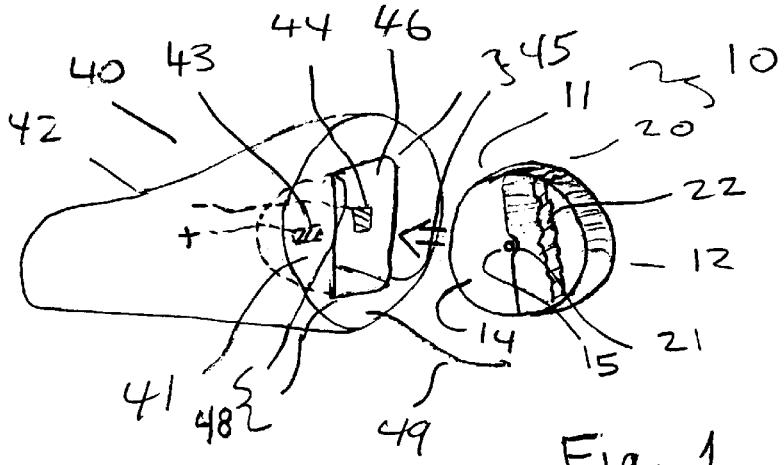
FIG. 1 is a perspective view of a canal hearing device of the present invention with the battery assembly shown outside the receptacle cavity as it is being inserted within.
Figure 2:
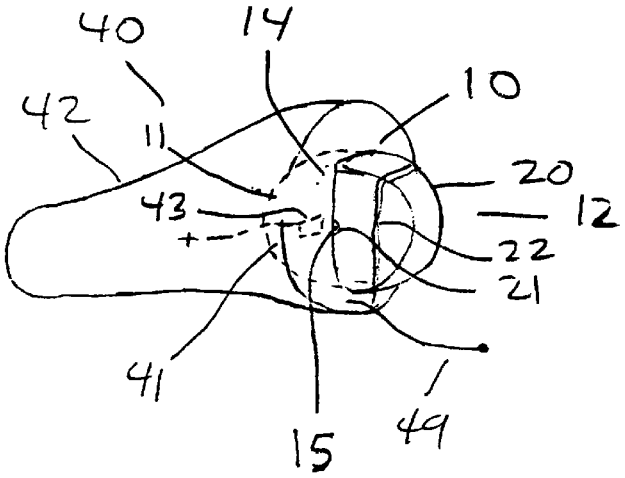
FIG. 2 is a perspective view of the canal hearing device of FIG. 1 with the battery assembly shown fully inserted into the receptacle cavity, yet having a protruding segment.
Figure 3A:
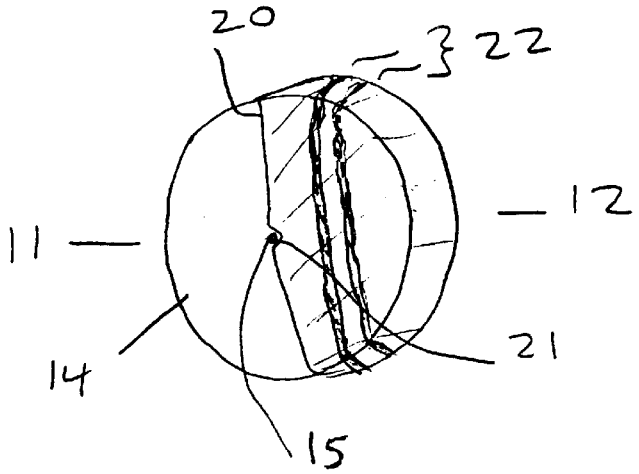
FIG. 3A is a detailed perspective view of the battery assembly showing the thin covering over the protruding segment of the battery assembly.
Figure 3B:
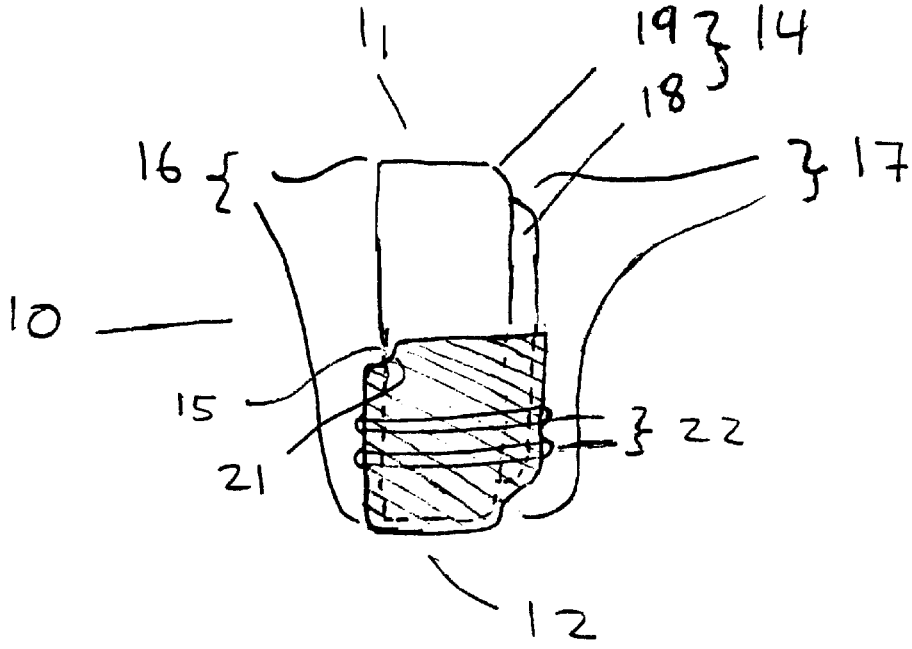
FIG. 3B is a side view of the battery assembly of FIG. 3A showing the positive and negative terminals of the battery and the covering over the protruding segment thereof.
Figure 3C:
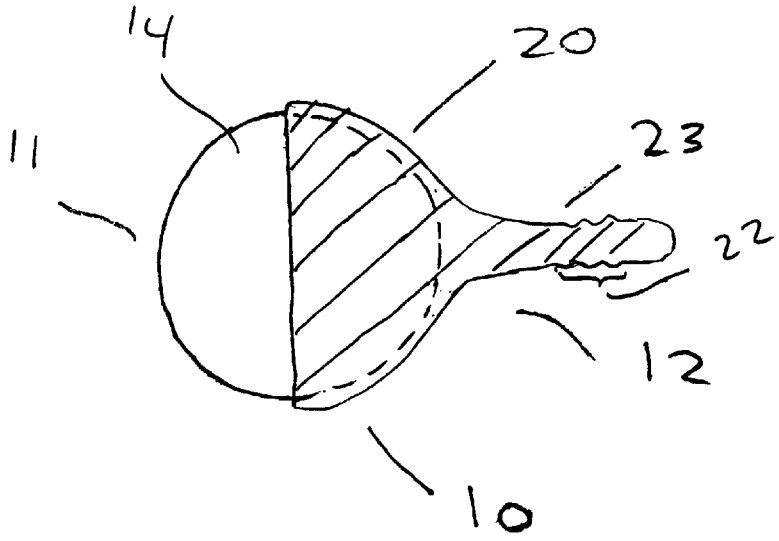
FIG. 3C is an end view of an alternate embodiment of the battery assembly with a grip handle incorporated onto the covering of the protruding segment.
Figure 4:
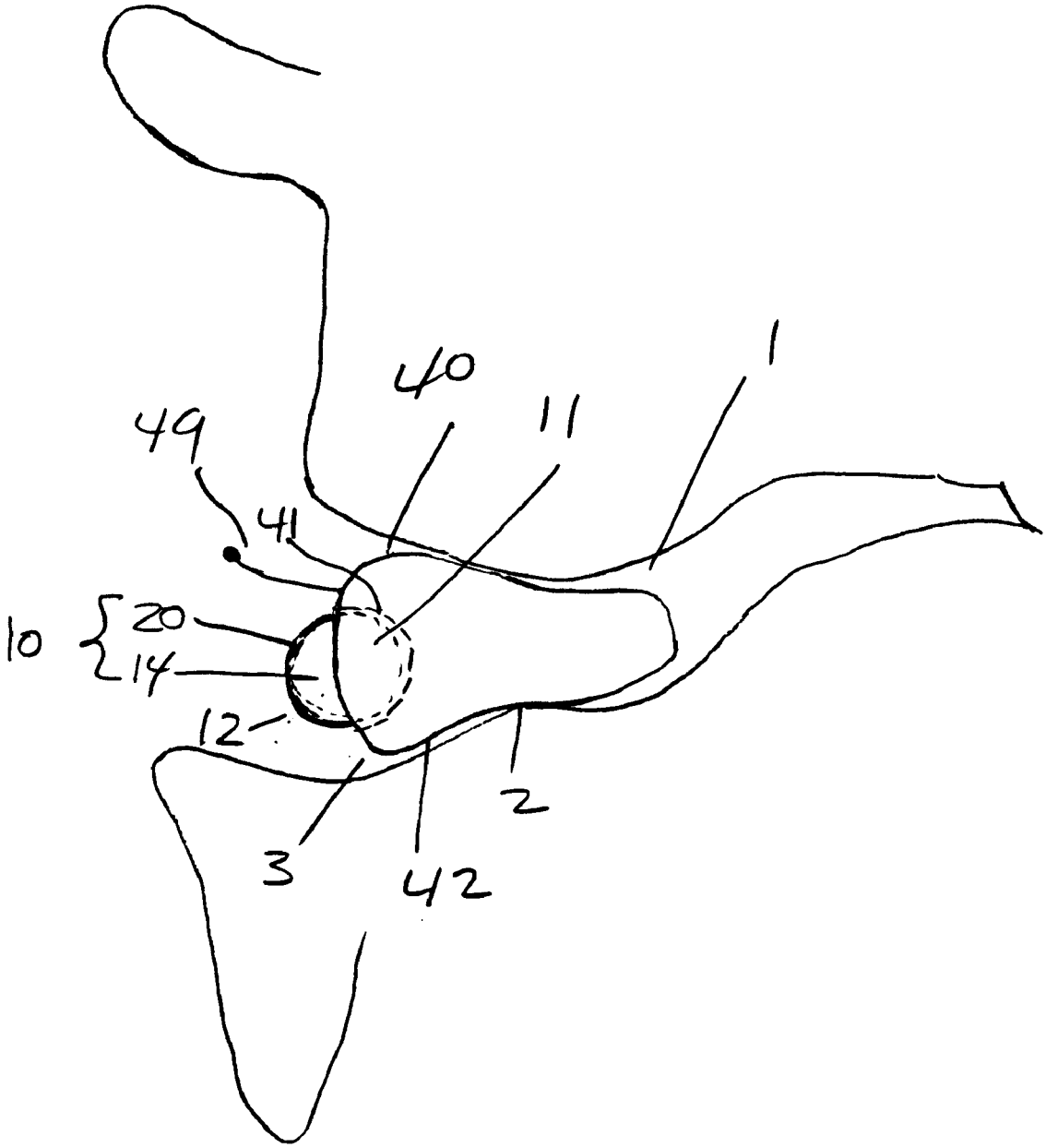
FIG. 4 is a side view of an ITC embodiment of the hearing device of the invention shown inserted in the ear canal.
Figure 5:
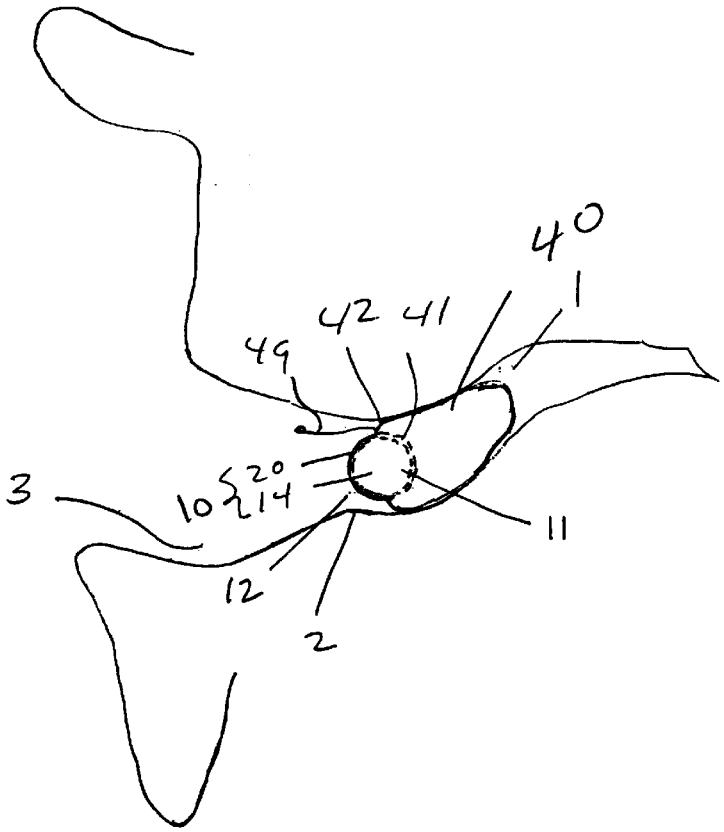
FIG. 5 is a side view of a CIC embodiment of the hearing device of the invention shown completely inserted in the ear canal.

The present invention, shown in illustrative embodiments in FIGS. 1–13, provides a space efficient battery assembly and convenient replacement method for miniature hearing devices. The battery assembly 10 is partially insertable into a receptacle cavity 41 within a hearing device 40. As shown in FIG. 1, battery assembly 10 is being moved toward insertion into receptacle cavity 41, and, as shown in FIG. 2, is fully seated within receptacle cavity 41 with a portion or segment 11 of the battery assembly 10 fully inserted into cavity 41 and a portion or segment 12 of the battery assembly 10 protruding from the hearing device 40. The battery assembly 10 comprises a battery cell 14 and a cap or covering 20 composed, for example, of thin plastic or silicon coating, which is affixed or molded onto what will become the protruding segment 12 of the battery assembly 10 when the battery assembly is fully seated. The protruding segment 12, then, remains outside the receptacle cavity 41 when the battery assembly 10 is operably inserted within cavity 41 (FIGS. 2, 4 and 5).

The insertable segment 11 provides electrical and mechanical connectivity within the receptacle cavity 41 of the hearing device. The limited insertion of the battery assembly conserves valuable space within the housing 42 of the hearing device 40. Further reduction in the size of the hearing device is achieved by eliminating a movable door or battery compartment typically employed in conventional hearing aid designs. The protruding segment 12 of the battery assembly 10 represents at least one-third of the total battery assembly in volume. In a preferred embodiment of the invention, the protruding segment 12 represents approximately 50% of the battery assembly 10.

The receptacle cavity 41 is shaped to conform to the shape of the insertable segment 11 to be seated therein, and comprises cavity opening 46, a first electrical contact 43 (FIGS. 1 and 2) and a second electrical contact 44 (FIG. 1). Electrical contacts 43 and 44 are positioned within cavity 41 to contact and electrically connect with positive 18 and negative 19 terminals (FIG. 3B), respectively, of battery assembly 10 when the insertable segment 11 is inserted into the cavity. FIGS. 1 and 2 are views of hearing device 40 just prior to insertion and after insertion, respectively, of the battery assembly 10.

An air-hole 15 is provided in the battery for battery aeration as required with high energy zinc-air batteries. The covering 20 must not cover the battery air-hole 15 in order for the battery to properly function when inserted within receptacle cavity 41. A relieved area 21 is provided within covering 20 (FIGS. 1, 3A and 3B) to allow air circulation into the battery hole. Air-hole 15 is typically initially covered by a removable tab 24 (FIG. 10A) to maximize the shelf-life of the battery cell 14 prior to its use. The air-hole may be completely covered by covering 20 (FIG. 7) or by other encapsulation means provided that such covering is air-permeable. This type of air-permeable covering is preferably moisture-proof to prevent damage to the battery cell when the device is exposed to water or humidity.

The covering 20 may be a molded part, separately made and affixed to the battery cell 14, or molded onto it directly. The covering 20 may also be achieved by dipping or coating the battery in or with an appropriate material such as silicone, parylene or conformal coating. The covering must be thin, and is less than 0.3 mm thick in the preferred embodiment of the invention. The thickness must be substantially less than that of the shell or battery enclosure used in conventional hearing aid design.

The battery assembly 10 is particularly suited for miniature devices that are positioned into the ear canal such as ITC and CIC devices shown in FIGS. 4 and 5, respectively. FIG. 4 is a sectional view containing the longitudinal axis of the ear canal, showing an ITC configuration with the hearing device 40 partially positioned in the concha area 3 and partially inserted into the ear canal 1 past the aperture 2 of the ear canal. FIG. 5 is a sectional view similar to that of FIG. 4, showing a CIC configuration with the device 40 inserted substantially into the ear canal past the aperture 2 thereof In either configuration, the protruding segment 12 of the battery assembly 10 is directly exposed to the environment of the ear outside the hearing device 40 as shown in FIGS. 4 and 5. An extraction handle 49 is provided to aid in the insertion or removal of the hearing device into and from the ear canal.

A standard hearing aid battery cell 14 (button cell type) typically has rounded edges 17 (FIG. 3B) on the side of the negative terminal 18 versus relatively sharp edges 16 on the side of the positive terminal 19. Therefore, in order to provide the correct electrical polarity for the circuitry within the hearing device 40, the receptacle cavity 41 may be provided with one or more rounded corners 45 and sharp corners 48 (FIG. 1) for keying and properly mating with the insertable segment 11 of the battery assembly. Consequently, the battery assembly 10 cannot be inserted incorrectly into the receptacle cavity 41.

Figure 6:
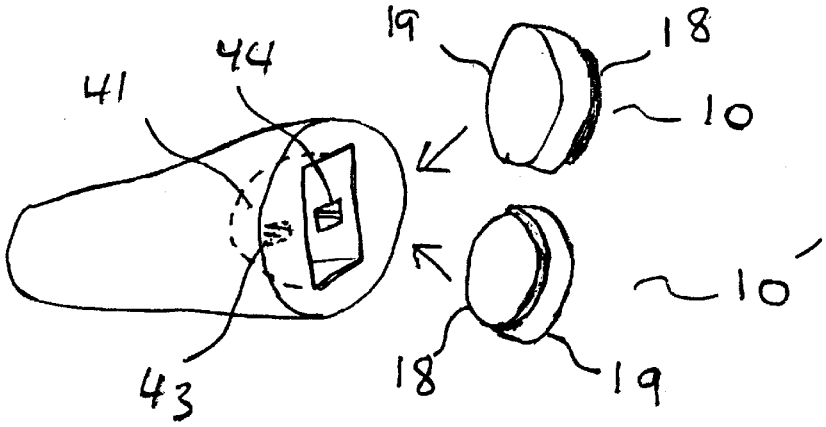
FIG. 6 is a perspective view of an embodiment of the hearing device of the invention having a bi-directional receptacle cavity for receiving the battery assembly in either orientation.

In an alternate embodiment, the receptacle cavity 41 has no rounded edges or other keying features for inserting a battery assembly in a unidirectional manner. This allows the battery assembly to be inserted in either orientation (10 or 10') as shown in FIG. 6, which is permitted if corrective circuitry is used to automatically correct for reverse polarities (see U.S. Pat. No. 5,623,550 to Killion, for example). This "bidirectional" insertion embodiment is particularly useful for persons who might have difficulty in properly orienting a miniature battery assembly, such as persons with limited manual dexterity or poor eyesight. Regardless of the mating configuration between the battery assembly and the receptacle cavity, the electrical contacts within the receptacle cavity must be reasonably protected from moisture and debris present in the outside environment. This is easily accomplished by providing a sealing fit, particularly at the rim of cavity opening 41.

The battery assembly of the present invention is highly accessible for insertion and removal without the need for a door or a movable battery compartment as with conventional hearing devices. To further facilitate insertion and removal in the preferred embodiments, the protruding segment 12 of the battery assembly is provided with one or more grip-ridges 22 along the covering 20, as shown in FIGS. 1, 2, 3A and 3B. A grip-ridge 22 is either incorporated into the covering 20 (molded by the same material for example), or alternatively provided as a separate structure attached thereto. The accessibility of the battery assembly in conjunction with the grip-ridge is particularly useful for the elderly who may have limited manual dexterity or poor eyesight. FIG. 3C shows an alternate embodiment with a grip-handle 23 incorporated with covering 20 to facilitate placement and removal of the battery assembly 10. The grip-handle 23 may include grip-ridge 22 as shown to further facilitate placement or removal.

Figure 7:
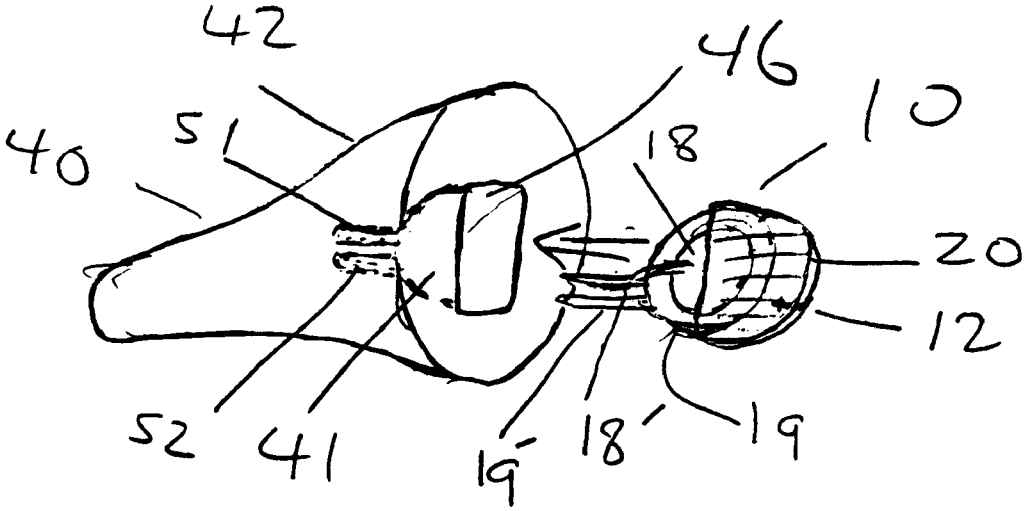
FIG. 7 is a perspective view of an embodiment of the hearing device in which the battery assembly has two protruding electrical contacts for mating with two contact receptacles within the receptacle cavity of the hearing device.
Figure 8:
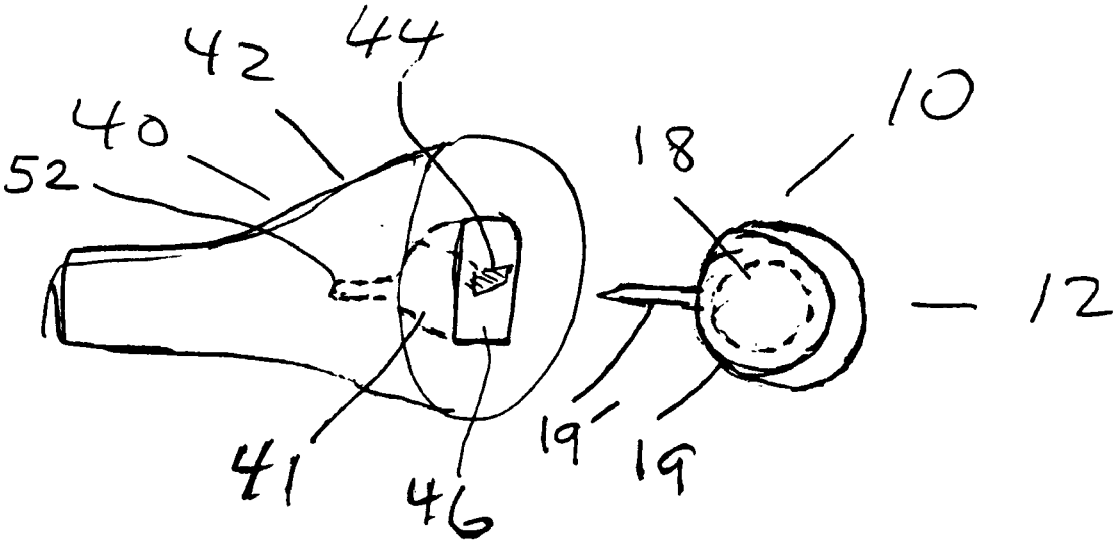
FIG. 8 is a perspective view of an embodiment of the hearing device in which the battery assembly has a single protruding electrical contact for mating with a single contact receptacle within the receptacle cavity of the hearing device.
Figure 9:
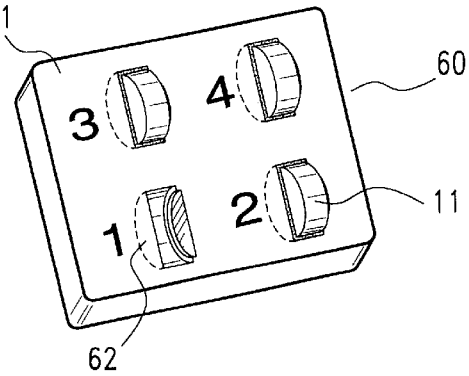
FIG. 9 is a perspective view of an embodiment of a battery dispenser with the insertable segment of each of several captive battery assemblies exposed and ready for selected insertion into a receptacle cavity of a hearing device.

The battery assembly of the present invention is alternatively provided with one or more protruding contacts for providing electrical and mechanical connectivity between the battery assembly 10 and the hearing device 40 as shown in FIGS. 7 and 8. In FIG. 7 two protruding contacts 18' and 19', connected to battery terminals 18 and 19, respectively, are insertable into contact receptacles 51 and 52 within receptacle cavity 41, respectively. In FIG. 8 only one protruding contact 19', connected to positive terminal 19, is provided for insertion into contact receptacle 52. The negative terminal 18 makes direct contact with electrical contact 44 within receptacle cavity 41 when battery assembly 10 is inserted within. FIG. 8 also shows an alternate embodiment of the battery assembly not having the covering 20 of the embodiment of FIG. 7. This is possible if the battery cell is made with an inherently protective surface, such as one of the exemplary materials mentioned above.

In a preferred embodiment of the invention, a battery dispenser 60 (FIG. 9) is provided to facilitate the placement of a battery assembly 10 into the receptacle cavity of the hearing device. The dispenser 60 directly transfers a battery assembly to a hearing device without resorting to any direct manual manipulation of the battery assembly. The battery dispenser 60 holds one or more battery assemblies in slots or cavities 62 (marked 1–4 in FIG. 9) within dispenser plate 61. The first slot (position 1) is shown vacant, merely to indicate that the battery assembly previously occupying that slot has already been used, and the other slots (positions 2–4) are shown each holding a battery assembly ready for transfer to a receptacle cavity 41 of a hearing device 40.

Figure 10A:
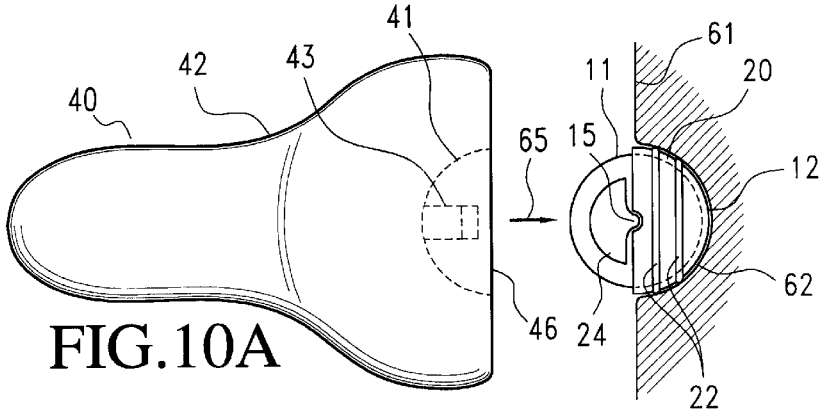
Figure 10B:
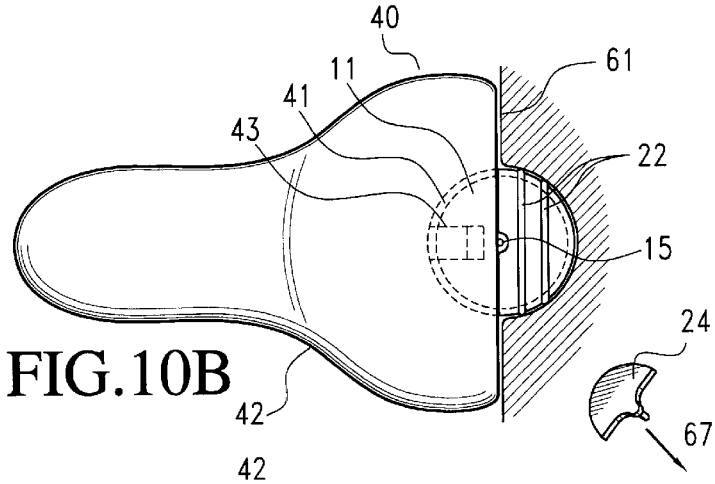
Figure 10C:
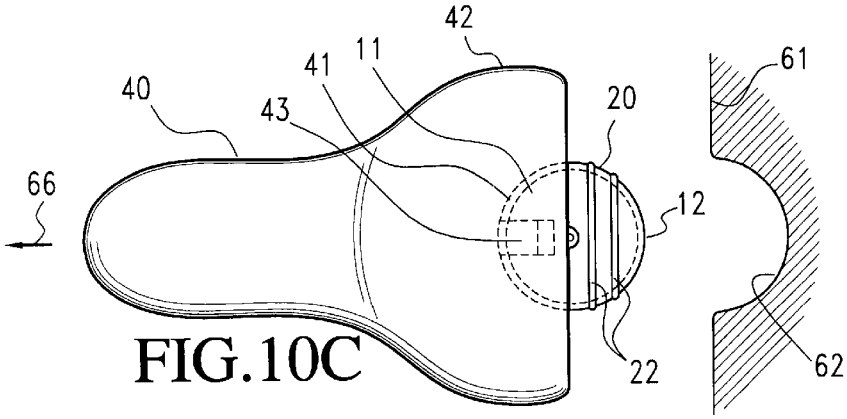

The transfer is shown in the sequence of steps of FIGS. 10A–10C. First, the user grasps the hearing device 40 and moves it in the direction of arrow 65 to introduce the receptacle cavity 41 onto the insertable segment 11 of battery assembly 10. The insertable segment 11 of battery assembly protrudes from dispenser plate 61 while the protruding segment 12 of battery assembly is initially held within the dispenser cavity 62 as shown in FIG. 10A. The air-hole 15 is covered by a removable tab 24 which keeps the battery fresh during its storage prior to its use. Once the insertable segment 11 of the battery assembly is fully inserted into the receptacle cavity 41 of the hearing device 40, as shown in FIG. 10B, the retention force within the receptacle cavity 41 causes the battery assembly 10 to disengage from the dispenser 60 as the user removes the hearing device away from the dispenser area (in the direction of arrow 66 as shown in FIG. 10C). The removable tab 24, being weakly adhered to the air-hole area, separates or pulls apart (in the direction of arrow 67 shown in FIG. 10B) from the battery assembly 10 during the insertion process, and is subsequently discarded.

In an alternative embodiment (not shown) the new or replacement battery assemblies may be aligned in a spring-loaded dispenser, electrically insulated from one another. As the battery assembly whose insertable segment protrudes from the case is inserted into the hearing device and thereby disengaged from the dispenser, the next battery assembly automatically pops into place under the force exerted by the spring loading, for replacement of the battery assembly in use in the hearing device when its energy is depleted.

Figure 11A:
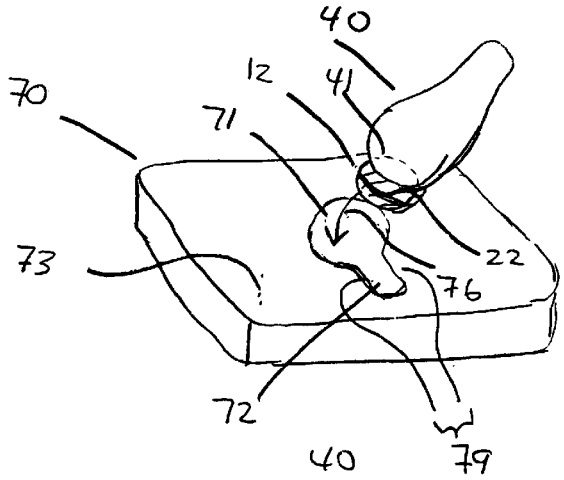
Figure 11B:
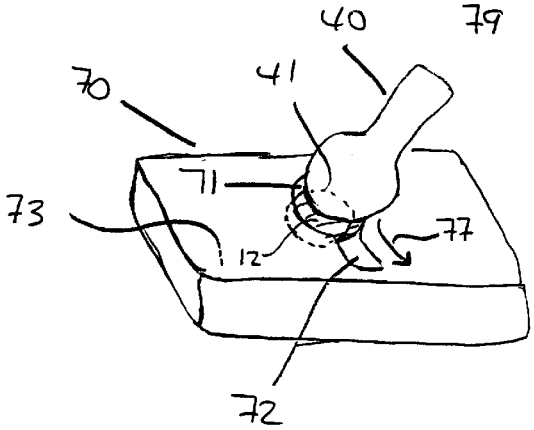
Figure 11C:
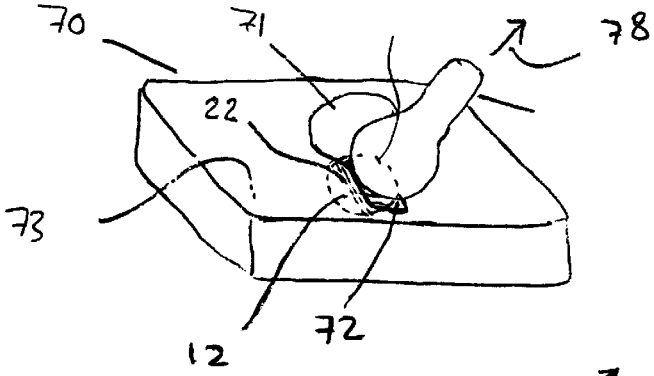
Figure 11D:
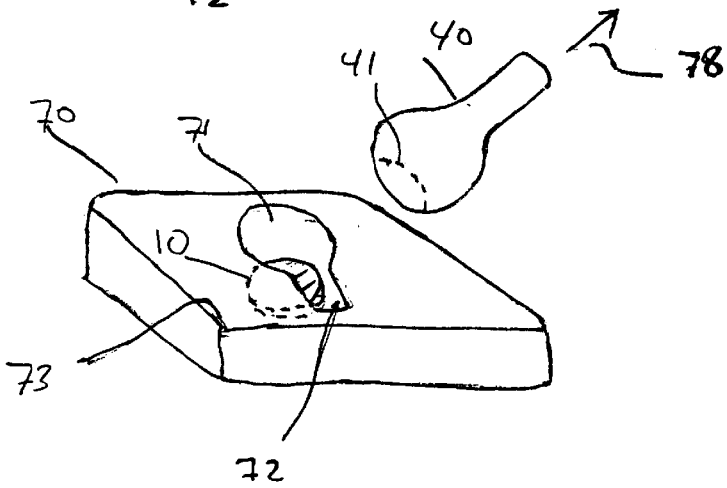

Although a grip-ridge 22 is provided to facilitate removal of the depleted battery assembly, an extractor device can be used to further facilitate removal of the battery assembly for those who may need it. An embodiment of an extractor device 70 is shown in FIGS. 11A–11D, which illustrate the exemplary sequence of steps to remove a depleted battery assembly without resorting to direct manipulation or touching of the battery assembly itself The protruding segment 12 of the battery assembly is first introduced (in the direction of arrow 76, FIG. 11A) into a guide cavity 71 within the extractor device 70. The guide cavity 71 is relatively large to easily position the protruding segment 12 in it and to guide it towards the removal slot 72 when the hearing device is pulled in the direction of arrow 77 (FIG. 11B). Once the protruding segment 12 is positioned into the removal slot, contact pressure aided by a grip-ridge 22 holds the battery segment firmly in the removal slot as the hearing device is pulled up in the direction of arrow 78 (FIGS. 11C and 11D). This holding force, being greater than the retention force of the receptacle cavity 41, causes the battery assembly 10 to disengage from the hearing device. When the disengagement is completed, the depleted battery assembly 73 drops into the disposal reservoir 73 as shown in FIG. 11D.

The holding force of the removal slot may be achieved in a variety of ways. For example, the edges 79 (FIG. 11A) of the removal slot 72 may be designed to slide over the grip-ridge 22 thus holding the depleted battery assembly once inserted within while the hearing device is removed. Alternatively, the removal slot edges 79 may be compressed inwardly, manually or otherwise, in order to grab and retain the battery assembly once inserted within, for removal as the hearing device is pulled away.

Figure 12:
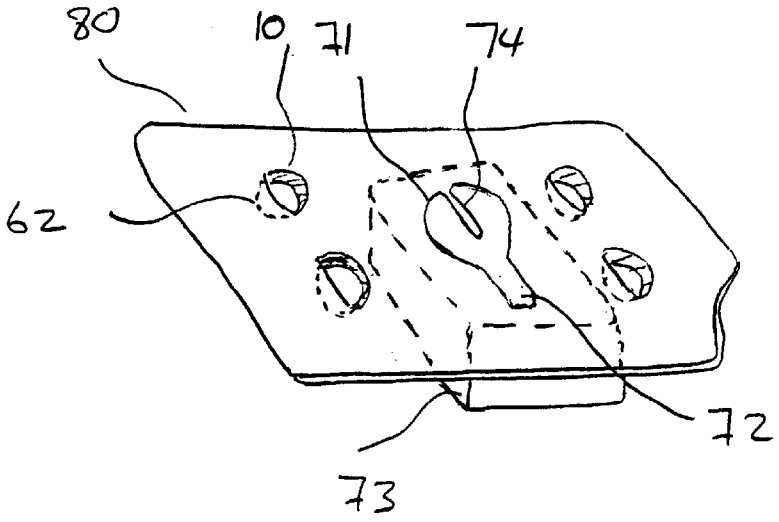
FIG. 12 is a perspective view of an alternate embodiment of a dispensing cartridge incorporating extractor device and disposal reservoir.

In a preferred embodiment of the invention, the battery dispenser, extractor device and disposal reservoir, are combined to form a unitary disposable cartridge 80 as shown in FIG. 12. A flexible retention tab 74 extending over the guide cavity 71 is provided to prevent inadvertent release of depleted battery assemblies from the disposal reservoir 73. In the alternative embodiment of the spring-loaded dispenser (not shown), the opposite end of the dispenser may house the extractor device and disposal reservoir.

Figure 13:
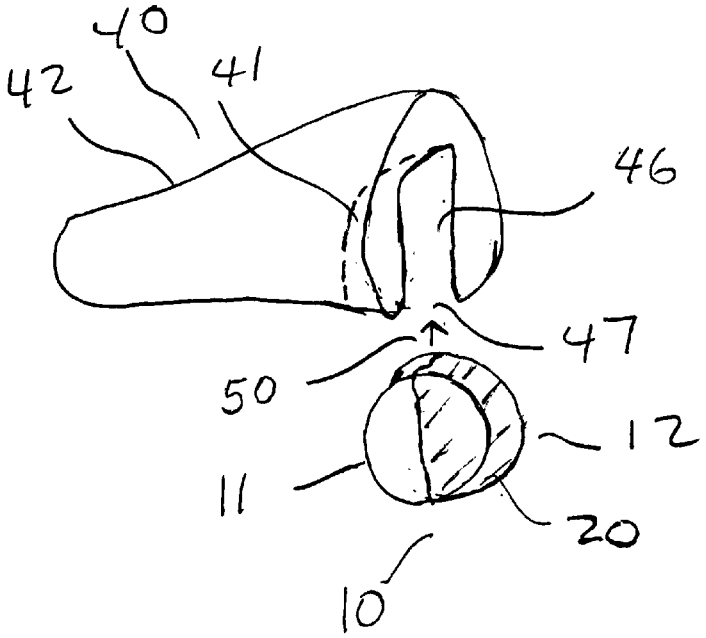
FIG. 13 is another embodiment of the hearing device in which the receptacle cavity thereof provides a side opening for inserting the battery assembly within.

In yet another embodiment of the invention, illustrated in FIG. 13, the receptacle cavity 41 of hearing device 40 includes a side opening 47 for side-sliding the battery assembly 10 in the direction of arrow 50, into the cavity. Removal of a spent battery may be achieved by an opposite side-sliding motion of the battery assembly 10. As in the other embodiments which have been described herein, once the insertable segment 11 is operably inserted into the receptacle cavity 41, the protruding segment 12 is left projecting from the hearing device.

The present invention, although particularly suited for cylindrical button-cell type batteries as shown in the above embodiments, is equally suited for other battery shapes and configurations as they are likely to become available in future hearing aid applications. The battery covering 20 in the present invention, regardless of the type of battery used, must be substantially in the shape of the protruding segment of the battery cell attached thereto.

Although a presently contemplated best mode of practicing the invention has been described herein, it will be recognized by those skilled in the art to which the invention pertains from a consideration of the foregoing description of presently preferred and alternate embodiments and methods of fabrication thereof, that variations and modifications of these exemplary embodiments and methods may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A miniature canal hearing device comprising:

a housing, an integrated battery assembly adapted to be removable from said housing, a receptacle cavity in said housing having a doorless opening for partially receiving said battery assembly through said opening, said battery assembly comprising:

a) an insertable segment for insertion into said receptacle cavity, and b) a protruding segment that remains outside of said receptacle cavity when said battery assembly is seated within said receptacle cavity, said insertable segment consisting of a portion of a battery having battery terminals exposed for electrically and mechanically connecting to electrical contacts within said receptacle cavity when said battery assembly is seated for retention therein, said protruding segment comprising at least one-third of the battery size, with a thin covering on the surface of the protruding segment, and being directly exposed to the ear environment outside the hearing device when said battery assembly is seated within said receptacle cavity and said hearing device is worn in the ear canal, whereby to provide a grippable portion to enable ready removal and replacement of a depleted battery through said doorless opening , and to conserve space within said housing for enhanced miniaturization to enable deep insertion of the hearing device into the ear canal.

2. The hearing device of claim 1 wherein said covering on the surface of said protruding segment is less than 0.3 mm in thickness.

3. The hearing device of claim 1, wherein said receptacle cavity is adapted to cooperate with an external battery dispenser that stores a plurality of battery assemblies arranged to be sequentially dispensed for individual insertion into said receptacle cavity for battery replacement in said hearing device upon battery depletion, without direct manual contact of a dispensed battery assembly by a user of said hearing device.

4. The hearing device of claim 1, wherein said receptacle cavity is adapted to cooperate with an external battery extractor for removing said battery assembly from said receptacle cavity, without direct manual contact of an extracted battery assembly by a user of said hearing device.

5. The hearing device of claim 3, wherein said battery dispenser includes a battery extractor for removing said battery assembly from said receptacle cavity of said hearing device.

6. The hearing device of claim 1, wherein said receptacle cavity is provided with keying features for unidirectional insertion of said insertable segment of said battery assembly to assure an operative electrical connection between said receptacle cavity and said battery assembly.

7. The hearing device of claim 1, wherein said receptacle cavity comprises a side opening for side-sliding of said battery assembly within.

8. An integrated battery assembly for powering a canal hearing device having a receptacle cavity with a doorless opening therein for receiving said battery assembly through said opening, said battery assembly comprising:

a) an insertable segment for insertion into said receptacle cavity, and b) a protruding segment for remaining outside of said receptacle cavity when said battery assembly is seated within said receptacle cavity, said insertable segment consisting of a portion of a battery having battery terminals exposed for electrically and mechanically connecting to electrical contacts within said receptacle cavity when said battery assembly is seated for retention therein, said protruding segment comprising at least one-third of the battery, with a thin covering on the surface thereof, directly exposed to the ear environment outside the hearing device when said battery assembly is seated within said receptacle cavity and said hearing device is worn in the ear canal, whereby to facilitate removal and replacement of a depleted battery through said doorless opening by providing a large surface of said protruding segment outside the hearing device which is easily grasped by a user, and to eliminate need for housing said protruding segment within an enclosure of the hearing device so as to optimize miniaturization of the hearing device to allow deep insertion of the device within the car canal.

9. The battery assembly of claim 8, wherein said covering on the surface of said protruding segment is less than 0.3 mm in thickness.

10. The battery assembly of claim 8, wherein said battery assembly is at least partially encapsulated with air-permeable moisture proof material.

11. The battery assembly of claim 8, wherein said protruding segment further comprises grip structures.

12. The battery assembly of claim 8, wherein said protruding segment further comprises a grip handle.

13. A canal hearing device comprising an enclosure with a receptacle configured to receive and retain a battery assembly insertable through a doorless opening therein; said battery assembly comprising an insertable portion adapted to be received and to seat within said receptacle for electrical and mechanical connection of the battery terminals to electrical contacts of the hearing device exposed within said receptacle, and the remaining portion of the battery assembly adapted to protrude from said receptacle through said opening for direct exposure to the ear environment when said battery assembly is seated for retention within said receptacle and said hearing device is worn in the ear canal, said remaining portion being at least one third of the volume of the battery assembly to enable said remaining portion to be readily grasped by a user of the hearing device for direct extraction of the battery assembly from said receptacle through said opening for replacement upon depletion of battery power, and to reduce the size of the device enclosure by approximately the size of said remaining portion of the battery assembly for improved miniaturization of the device.

14. The hearing device of claim 13, wherein said remaining portion of the battery assembly is covered with a thin encapsulation.

15. The hearing device of claim 14, wherein said encapsulation is less than 0.3 mm in thickness.

16. The hearing device of claim 13, wherein said second segment has a grip structure.

17. The hearing device of claim 13, wherein said receptacle is configured and adapted to cooperate with an external battery dispenser having a store of battery assemblies arranged to be sequentially dispensed for individual insertion into said receptacle for battery replacement without direct manual contact of a dispensed battery assembly by the wearer.

18. The hearing device of claim 13, wherein said receptacle is configured and adapted to cooperate with an external extractor for removing an inserted battery assembly from said receptacle.

19. The hearing device of claim 17, wherein said battery dispenser includes a battery extractor for removing a depleted battery assembly from said receptacle before a new battery assembly is dispensed for insertion therein.

20. The hearing device of claim 13, wherein said receptacle is keyed for unidirectional insertion of said insertable portion of the battery assembly to assure an operative electrical connection between said battery assembly terminals and said electrical contacts.

21. A canal hearing device comprising:

a housing with a receptacle having a doorless opening for insertion of an integrated battery assembly into said receptacle to connect battery terminals of the assembly to electrical contacts within the receptacle;

said receptacle being shaped to conform directly to the entire shape of a limited portion of the battery assembly for snug seating and retention in said receptacle solely by mechanical and electrical connection with said contacts, with at least one-third of the battery assembly protruding from said receptacle through said opening and outside said housing, for direct exposure to the ear environment and aeration when said hearing device is worm in the ear canal, and to enable a user of the hearing device to readily grasp said protruding portion for direct extraction of the battery assembly from said receptacle for replacement.

* * * * *